US011230968B2

(12) United States Patent
Hankwitz et al.

(10) Patent No.: US 11,230,968 B2
(45) Date of Patent: Jan. 25, 2022

(54) FRAMELESS COOLING MODULE

(71) Applicant: Modine Manufacturing Company, Racine, WI (US)

(72) Inventors: Ryan Hankwitz, Racine, WI (US); Allison M Kirklin, Racine, WI (US); Zachary T Ouradnik, Oak Creek, WI (US); Eric Lamberton, Mount Pleasant, WI (US)

(73) Assignee: Modine Manufacturing Company, Racine, WI (US)

( * ) Notice: Subject to any disclaimer, the term of this patent is extended or adjusted under 35 U.S.C. 154(b) by 463 days.

(21) Appl. No.: 16/280,576

(22) Filed: Feb. 20, 2019

(65) Prior Publication Data

US 2019/0257244 A1 Aug. 22, 2019

Related U.S. Application Data

(60) Provisional application No. 62/632,697, filed on Feb. 20, 2018.

(51) Int. Cl.
*F02B 63/04* (2006.01)
*F28F 9/00* (2006.01)
(Continued)

(52) U.S. Cl.
CPC ..... *F02B 63/044* (2013.01); *F01P 3/18* (2013.01); *F01P 5/06* (2013.01); *F01P 11/10* (2013.01);
(Continued)

(58) Field of Classification Search
CPC ..... F02B 63/044; F02B 2063/045; F01P 3/18; F01P 2003/182; F01P 2003/185;
(Continued)

(56) References Cited

U.S. PATENT DOCUMENTS 2,207,147 A * 7/1940 Gilbertson ..... B60K 11/085 49/91.1
3,627,035 A * 12/1971 Astrup ..... F28F 9/001 165/82
(Continued)

FOREIGN PATENT DOCUMENTS

CN 1936485 A 3/2007
CN 106812587 A 6/2017
(Continued)

OTHER PUBLICATIONS

Extended European Search Report for Application No. 18211117.9 dated Apr. 2, 2019, European Patent Office (7 pages).
(Continued)

*Primary Examiner* — Len Tran
*Assistant Examiner* — Gustavo A Hincapie Serna
(74) *Attorney, Agent, or Firm* — Michael Best & Friedrich LLP

(57) ABSTRACT

A frameless cooling module includes a first and a second shroud panel arranged at opposing sides of the module and extending from the front of the module to the back of the module. At least one L-shaped stiffener bracket extends between the panels at an intermediate location along both the height direction and the depth direction of the module. One or more heat exchangers is arranged within the cooling module between the L-shaped stiffener bracket and the front of the module, and is at least partially secured within the cooling module by being mounted to the L-shaped stiffener bracket.

12 Claims, 4 Drawing Sheets

(51) Int. Cl.
*F01P 5/06* (2006.01)
*F01P 11/10* (2006.01)
*F01P 3/18* (2006.01)

(52) U.S. Cl.
CPC ..... *F28F 9/001* (2013.01); *F01P 2003/185* (2013.01); *F02B 2063/045* (2013.01); *F28F 2009/004* (2013.01); *F28F 2280/06* (2013.01)

(58) Field of Classification Search
CPC ..... F01P 2003/187; F01P 5/06; F01P 11/00; F01P 11/10; F28F 2009/004; F28F 2280/06; F28F 9/001; F24F 1/0059; F24F 1/0063; F24F 1/0323; F24F 1/16; F24F 13/30; B60K 11/01; B60K 11/085
USPC ..... 165/148, 149, 67, 76, 78; 180/68.4
See application file for complete search history.

(56) References Cited

U.S. PATENT DOCUMENTS

| | | | | |
|---|---|---|---|---|
| 5,360,059 | A | 11/1994 | Olson | |
| 5,971,062 | A | 10/1999 | Sadr et al. | |
| 6,189,492 | B1 | 2/2001 | Brown | |
| 6,386,273 | B1 * | 5/2002 | Hateley | F28F 9/002 165/149 |
| 6,427,766 | B2 | 8/2002 | Zobel et al. | |
| 6,474,727 | B1 | 11/2002 | Guyomard | |
| 6,817,404 | B2 | 11/2004 | Frana-Guthrie et al. | |
| 6,907,916 | B2 * | 6/2005 | Koyama | F28F 9/002 165/67 |
| 6,908,283 | B2 | 6/2005 | Soofer et al. | |
| 9,751,394 | B1 * | 9/2017 | Speichinger | B60K 11/04 |
| 2003/0079858 | A1 * | 5/2003 | Frana-Guthrie | F01P 3/18 165/43 |
| 2004/0200598 | A1 | 10/2004 | Hitt et al. | |
| 2005/0217907 | A1 * | 10/2005 | Madson | B60K 11/06 180/68.1 |
| 2007/0062671 | A1 | 3/2007 | Sugimoto et al. | |
| 2009/0145577 | A1 * | 6/2009 | Shuttleworth | F01P 5/06 165/47 |
| 2011/0011661 | A1 * | 1/2011 | Takahashi | B62D 25/084 180/68.4 |
| 2011/0284301 | A1 * | 11/2011 | Bui | B60K 11/04 180/68.4 |
| 2015/0210156 | A1 * | 7/2015 | Manubolu | B60K 11/02 180/68.1 |
| 2015/0283895 | A1 | 10/2015 | Takahashi | |
| 2016/0091261 | A1 | 3/2016 | Gopireddy et al. | |
| 2017/0292789 | A1 * | 10/2017 | Hjorth | F28F 9/001 |

FOREIGN PATENT DOCUMENTS

| | | | | |
|---|---|---|---|---|
| CN | 210141172 | U | 3/2020 | |
| DE | 4305928 | A1 * | 9/1994 | F04D 29/542 |
| EP | 1284406 | A2 | 2/2003 | |
| EP | 2067952 | A2 | 6/2009 | |
| WO | 0194706 | A1 | 12/2001 | |

OTHER PUBLICATIONS

First Office Action issued from the Chinese Patent Office for related Application No. 201910125900.1 dated Nov. 20, 2020 (15 Pages).

* cited by examiner

FRAMELESS COOLING MODULE

CROSS-REFERENCE TO RELATED APPLICATIONS

This application claims priority to U.S. provisional patent application No. 62/632,697, filed on Feb. 20, 2018, the entire contents of which are hereby incorporated by reference in their entirety.

BACKGROUND

Cooling modules for internal combustion engines contain one or more heat exchangers and an air mover such as a fan, and are commonly used to reject heat from fluids and/or gases for the internal combustion engine to a flow of ambient air directed through the cooling module by the air mover. As the size and power of the internal combustion associated with the cooling module increases, the size and complexity of the cooling module likewise increases. In some cases, such as with combustion engines for power generation (sometimes referred to as gen-sets), the structure required to adequately support the heat exchangers, air mover, and other associated equipment can become complex and expensive.

FIG. 1 depicts a known example of such a cooling module 101 for a gen-set. The cooling module 101 includes several heat exchangers 30, 31 (for example, radiators, oil coolers, charge-air coolers) from which heat is to be rejected arranged at a front end of the cooling module. A fan (not shown) is arranged at the back end of the cooling module to direct a flow of cooling air through the heat exchangers.

The heat exchangers 30, 31 are mounted into a frame 150 of the cooling module (as best seen in FIG. 2) in order to provide the requisite structural support for the heat exchangers. The frame 150 also serves as a support for shroud panels 102 that extend between the back of the cooling module 101 and the frame 150. The shroud panels 102 serve to duct the air flow from the heat exchangers to the air mover, to ensure that the air is, to the greatest extent possible, drawn through the heat exchangers, thereby maximizing the cooling effect.

The frame 150, while capable of providing adequate structural support, is a complex structure that requires many parts to be assembled in a time-intensive and costly manner. FIG. 3 illustrates a detail of the frame 150, with the heat exchanges removed for clarity, to illustrate this point. The frame 150 is constructed of multiple formed steel U-channels that are joined together with mechanical fasteners in order to form channels within which the heat exchangers can be placed and secured. In order to provide the frame 150 with the requisite stiffness, and to prevent angular deformation of the frame 150, multiple steel gussets 152 are needed at the joints between the U-channels 151. Each of these gussets 152 must also be secured to the U-channels 151 by multiple fasteners, thereby increasing the cost and the assembly time even more.

In order to secure the heat exchangers 30, 31 within the frame 150, the U-channels 151 have to be assembled around the heat exchangers, as there is no way to locate the heat exchangers within the channels once the frame 150 is assembled. This makes servicing and replacement of the heat exchangers within the cooling module 101 difficult, since the frame 150 needs to be at least partially disassembled in order to replace and service any one of the heat exchangers.

SUMMARY

According to an embodiment of the invention, a frameless cooling module is constructed using a first and a second shroud panel arranged at opposing side of the cooling module. The first and second shroud panels each extend entirely from a front of the cooling module to the back of the cooling module in the front-to-back direction of the cooling module. The first and second shroud panels also extend entirely from the top of the cooling module to the bottom of the cooling module in the top-to-bottom direction of the cooling module. The front-to-back direction thereby defines a first direction of the cooling module and the top-to-bottom direction thereby defines a second direction of the cooling module, with the first and second directions being perpendicular to one another. A third direction of the cooling module perpendicular to both the first and the second directions extends perpendicular to the planes of both the first and the second shroud panels, such that the cooling module is bounded in the third direction by the opposing first and second shroud panels.

An L-shaped stiffener bracket extends between the first and second shroud panels in that third direction. In some embodiments the frameless cooling module includes only a single L-shaped stiffener bracket, whereas in other embodiments the cooling module includes two or more such L-shaped stiffener brackets. The L-shaped stiffener bracket is located, along the first direction, at an intermediate location between the front of the module and the back of the module. In other words, the location of the L-shaped stiffener bracket is offset from both the front of the cooling module and from the back of the cooling module in the first direction. The L-shaped stiffener bracket is also located, along the second direction, at an intermediate location between the top of the cooling module and the bottom of the cooling module. In other words, the L-shaped stiffener bracket is offset from both the top of the cooling module and from the bottom of the cooling module in the second direction.

The L-shaped stiffener bracket includes a first planar wall, a second planar wall, and a right angle bend joining the first and second planar walls. The first planar wall is arranged to be parallel to the front and the back of the cooling module, while the second planar wall is arranged to be parallel to the top and the bottom of the cooling module. The L-shaped bracket can, for example, be formed by bending a flat sheet of metal ninety degrees to form the right angle bend.

The L-shaped stiffener bracket is joined to the first shroud panel by a first formed corner bracket and is joined to the second shroud panel by a second formed corner bracket. Each one of the first and second formed corner brackets is provided with a planar surface, and each one of the formed corner brackets is joined to the corresponding shroud panel by way of the planar surface. The formed corner brackets are additionally provided with formed flanges that extend perpendicularly from the planar surface. A first one of the formed flanges of each of the first and second formed corner brackets is used to join the formed corner bracket to the first planar wall of the L-shaped stiffener bracket. A second one of the formed flanges of each of the first and second formed corner brackets is used to join the formed corner bracket to the second planar wall of the L-shaped stiffener bracket.

In at least some embodiments, the planar surface of the formed corner brackets is in the shape of a right triangle. In other embodiments, the planar surface is in the shape of a square, a rectangle, a rhomboid, or some other shape.

In at least some embodiments, the formed corner brackets are joined to the corresponding shroud panels by mechanical fasteners such as screws, bolts, rivets, or the like. The planar surface of the formed corner bracket is disposed against a surface of the shroud panel, and apertures extending through the planar surface of the formed corner bracket to receive the fasteners are aligned with corresponding apertures of the shroud panel so that the mechanical fasteners can be inserted through the aligned apertures in order to mechanically fasten the formed corner bracket to the shroud panel.

In at least some embodiments, the formed corner brackets are joined to the L-shaped stiffener bracket by mechanical fasteners such as screws, bolts, rivets, or the like. The first and second formed flanges of the formed corner bracket are disposed against the first and second walls, respectively, of the L-shaped stiffener bracket, and apertures extending through the formed flanges of the formed corner bracket to receive the fasteners are aligned with corresponding apertures of the L-shaped stiffener bracket so that the mechanical fasteners can be inserted through the aligned apertures in order to mechanically fasten the formed corner bracket to the stiffener bracket.

Heat exchangers are arranged within the cooling module between the first planar wall of the L-shaped stiffener bracket and the front of the cooling module in the first direction. In at least some embodiments, the intermediate location of the L-shaped stiffener bracket along the first direction is selected such that the distance between the front of the cooling module and the first wall of the L-shaped stiffener bracket is approximately equal to the depth of the heat exchangers. One or more of the heat exchangers are arranged to be between the second planar wall of the L-shaped stiffener bracket and either the top or the bottom of the cooling module in the second direction. In at least some embodiments, the intermediate location of the L-shaped stiffener bracket along the second direction is selected such that the distance between the top or the bottom of the cooling module and the second wall of the L-shaped stiffener bracket is approximately equal to the height of one or more of the heat exchangers.

At least some of the heat exchangers arranged within the module can be structurally mounted to the first planar wall of the L-shaped stiffener bracket in order to at least partially secure those heat exchangers within the cooling module.

In some embodiments, the L-shaped stiffener bracket is one of several (i.e. two or more) L-shaped stiffener brackets. Another one of the L-shaped stiffener brackets also extends between the first and second shroud panels at an intermediate location between the front of the cooling module and the back of the cooling module in the first direction, and at an intermediate location between the top of the cooling module and the bottom of the cooling module in the second direction. That L-shaped stiffener bracket is joined to the shroud panels by additional ones of the formed corner brackets. One or more heat exchangers are arranged within the cooling module between the first planar wall of that L-shaped stiffener bracket and the front of the cooling module, and are structurally mounted to the first planar wall of that L-shaped stiffener bracket to at least partially secure those heat exchanger within the cooling module.

In at least some such embodiments, the first planar wall of one of the L-shaped stiffener brackets is aligned in a common plane with the first planar wall of another of the L-shaped stiffener brackets.

In at least some such embodiments, the first planar wall of one of the L-shaped stiffener brackets extends from the second planar wall of that L-shaped stiffener bracket towards the top of the cooling module, and the first planar wall of another of the first and second L-shaped stiffener brackets extends from the second planar wall of that L-shaped stiffener bracket towards the bottom of the cooling module.

In at least some such embodiments, the second planar wall of one of the L-shaped stiffener brackets abuts against, and is joined to, the second planar wall of another of the L-shaped stiffener brackets. In some such embodiments the two L-shaped stiffener brackets are joined together at least in part by one or more fasteners that extend through aligned apertures in the second planar walls of the L-shaped stiffener brackets and in formed flanges of the formed corner brackets that join those L-shaped stiffener brackets to the shroud panels.

In some embodiments, the cooling module includes a top panel arranged at the top end of the cooling module, and a bottom panel arranged at the bottom end of the cooling module. The top and bottom panels each extend between, and are joined to, the first and second shroud panels. At least one of the top and bottom panels extends from the back of the cooling module to an intermediate location between the front of the cooling module and the back of the cooling module in the first direction.

In at least some such embodiments, that one of the top and bottom panels includes a flange aligned in a common plane with the first planar wall of the L-shaped stiffener bracket. The heat exchanger or heat exchangers that are structurally mounted to that first planar wall are also structurally mounted to the flange of the top or bottom panel in order to at least partially secure the heat exchanger or heat exchangers within the cooling module.

In at least some such embodiments, both of the top and the bottom panels include a flange, with the flange of one of the panels aligned in a common plane with the first planar wall of one of the L-shaped stiffener brackets and the flange of the other one of the panels aligned in a common plane with the first planar wall of another one of the L-shaped stiffener brackets. In at least some embodiments, those flanges and planar walls are all aligned within one common plane. At least some heat exchangers are structurally mounted to the first planar wall of one of the L-shaped stiffener brackets and the flange of the top panel in order to secure those heat exchangers within the cooling module, and at least some of the heat exchangers are structurally mounted to the first planar wall of the other one of the L-shaped stiffener brackets and the flange of the bottom panel in order to secure those heat exchanger within the cooling module.

DETAILED DESCRIPTION

Before any embodiments of the invention are explained in detail, it is to be understood that the invention is not limited in its application to the details of construction and the arrangement of components set forth in the following description or illustrated in the accompanying drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 4:
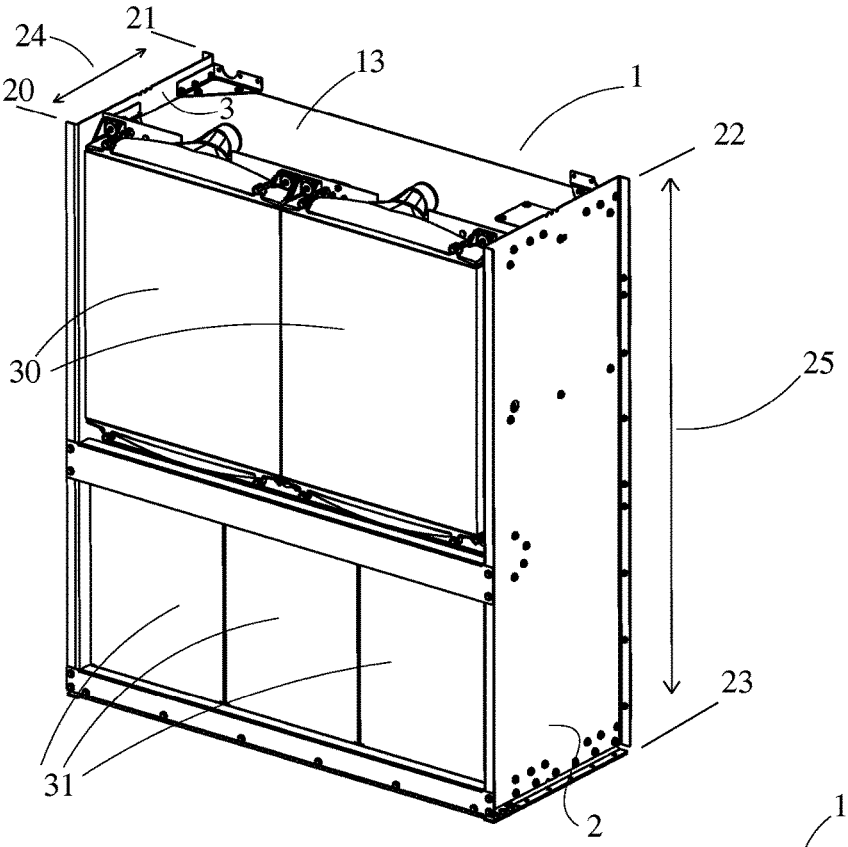
FIG. 4 is a perspective view of a frameless cooling module according to an embodiment of the invention.
Figure 5:
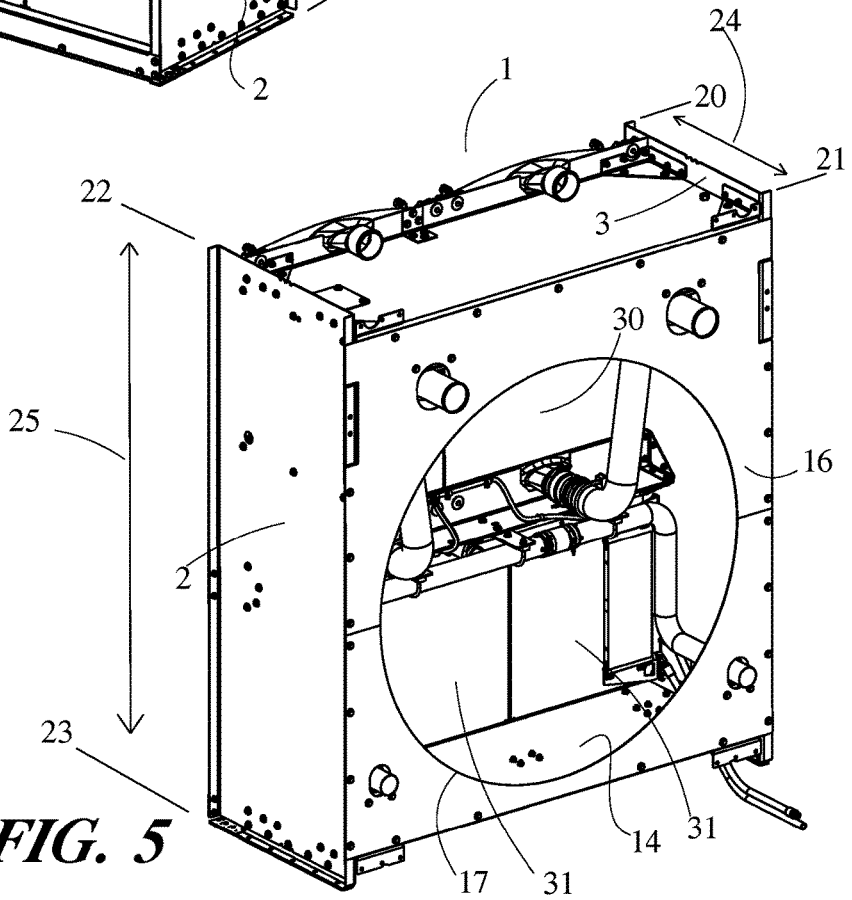
FIG. 5 is a perspective view of the back side of the frameless cooling module of FIG. 4.

A cooling module 1 according to an embodiment of the invention is depicted in FIGS. 4 and 5. The cooling module 1 is particularly well-suited for use in a stationary power generation system, such as a diesel generator (or "gen-set") system. Such a system will typically have one or more fluids from which heat needs to be rejected, such as, for example, engine coolant and lubricating oil. Heat exchangers to accomplish the required heat rejection are arranged within the cooling module 1, which can be located in generally close proximity to the diesel engine of the gen-set and which can be fluidly connected thereto by hoses and other fluid conduits. It should be understood, however, that the cooling module 1 is not restricted to being used in conjunction with such a system, and could similarly find use in other systems where heat rejection from fluids is desirable.

The exemplary cooling module 1 includes a set of heat exchangers 30 arranged at a front end 20 of the cooling module, along with another set of heat exchangers 31 also arranged at the front end 20. In some cases, the heat exchangers 30 can cool one type of fluid (for example, engine coolant) while the heat exchangers 31 cool another type of fluid (for example, lubricating oil). In other cases the cooling module might contain only heat exchangers for a single fluid. In certain cases a fluid is cooled in multiple heat exchangers, such as when the size of a single heat exchanger for cooling the fluid makes it more desirable—for reasons of cost, manufacturability, or other reasons—to divide the total heat transfer duty amongst multiple heat exchangers arranged in parallel. In other cases it might be desirable to have multiple heat exchangers arranged in parallel because the heat sources are similarly distributed. By way of example, a single cooling module 1 can be used to simultaneously cool the fluids for multiple diesel engines, each of which has one or more dedicated heat exchangers within the cooling module.

A fan (not shown) can be arranged at a back end 21 of the cooling module opposite the front end 20. The fan can be mounted to a back panel 16 of the cooling module 1, which is provided with a circular aperture 17 that generally conforms to the swept area of the fan. In this way, cooling air to which the heat from the fluids traveling through the heat exchangers 30, 31 can be rejected is directed from the front 20 to the back 21 in a depth direction 24 of the cooling module.

Figure 1:
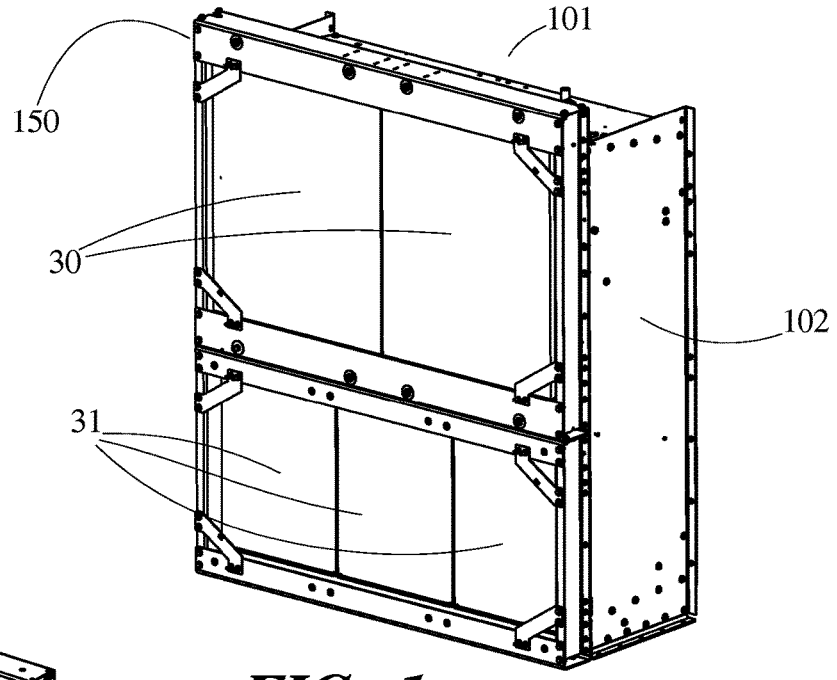
FIG. 1 PRIOR ART
FIG. 1 is a perspective view of a previously known gen-set cooling module.
Figure 2:
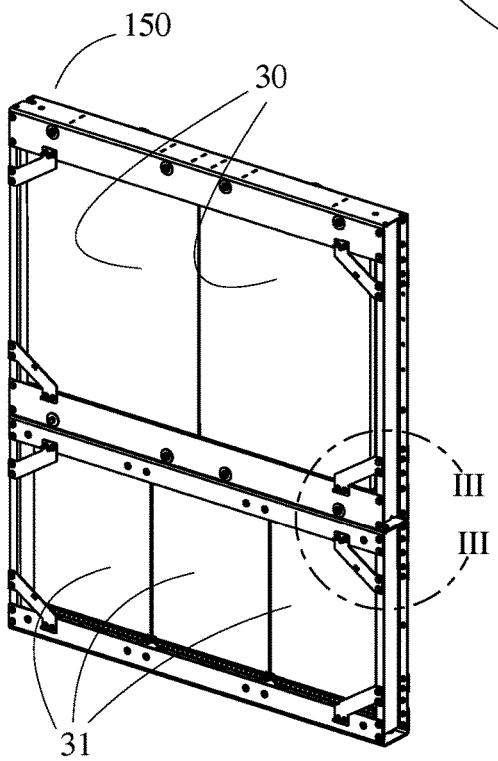
FIG. 2 PRIOR ART
FIG. 2 is a perspective view of a structural frame portion of the gen-set cooling module of FIG. 1.
Figure 3:
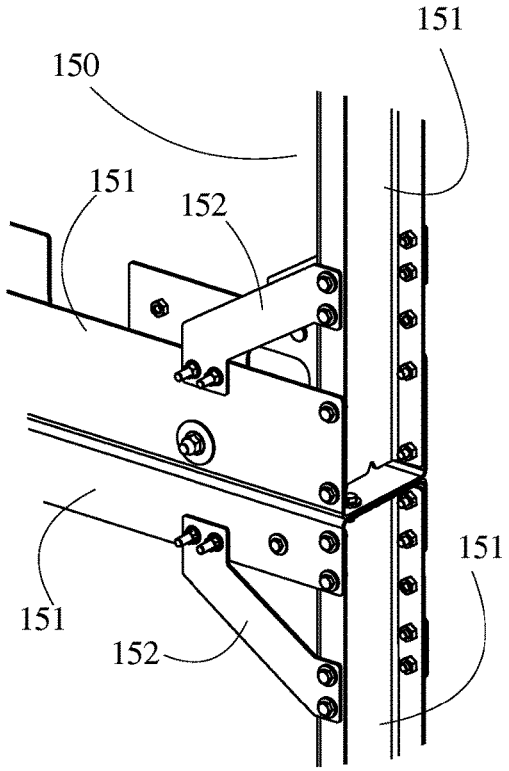
FIG. 3 PRIOR ART
FIG. 3 is a detail view of the portion of the structural frame of FIG. 2 within the dashed boundary III-III.

In contrast to the cooling module 101 of FIGS. 1-3, the cooling module 1 is a frameless cooling module. As will be described in greater detail hereafter, the heat exchangers are indirectly supported within the cooling module 1 by a first shroud panel 2 and a second shroud panel 3, each of which extends from the front 20 of the cooling module 1 to the back 21 of the cooling module 1 in the depth direction 24. The shroud panels 2, 3 are arranged at opposing sides of the cooling module 1 in a width direction so that, when viewing the front 20 of the cooling module 1, the first shroud panel 2 is arranged at the right hand side and the second shroud panel 3 is arranged at the left hand side. Each of the shroud panels 2, 3 also extends from a top 22 of the cooling module 1 to a bottom 23 of the cooling module 1 in a height direction 25 of the cooling module 1.

Figure 6:
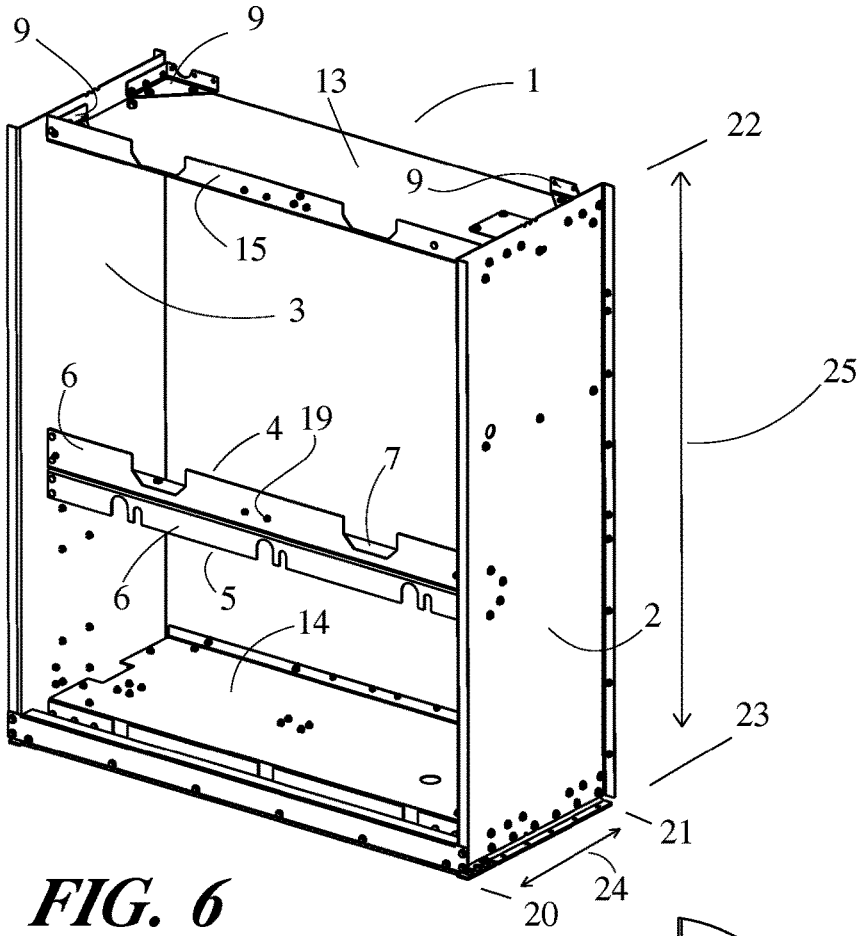
FIG. 6 is a perspective view of the frameless cooling module of FIG. 4 with select components removed.

As best seen in FIG. 6, which shows the cooling module 1 as it is depicted in FIG. 4 but with the heat exchangers 30, 31 removed for clarity, the cooling module 1 is also provided with at least one L-shaped stiffener bracket 4 that extends in the width direction between the shroud panel 2 and the shroud panel 3. A portion of the L-shaped stiffener bracket 4 can be seen in FIG. 7 from the same perspective as that of FIG. 5. The stiffener bracket 4 is referred to as "L-shaped" on account of it having a first planar wall 6, and a second planar wall 7 arranged perpendicular to the first planar wall 6, with the walls 6, 7 joined together by a right angle bend 8. The L-shaped stiffener bracket 6 can be readily formed by bending a flat sheet of metal material to form the right-angle bend 8.

The L-shaped stiffener bracket 4 is arranged within the cooling module in such a way that the planar wall 6 is perpendicular to the depth direction 24, e.g. parallel to the front 20 and the back 21, and the planar wall 7 is perpendicular to the height direction 25, e.g. parallel to the top 22 and the bottom 23. Furthermore, the L-shaped stiffener bracket 4 is located within the cooling module 1 such that the planar wall 6 is at an intermediate location along the depth direction 24 between the front 20 and the back 21 of the cooling module 1. In addition, the L-shaped stiffener bracket 4 is located within the cooling module 1 such that the planar wall 7 is at an intermediate location along the height direction 25 between the top 22 and the bottom 23 of the cooling module 1.

Figure 7:
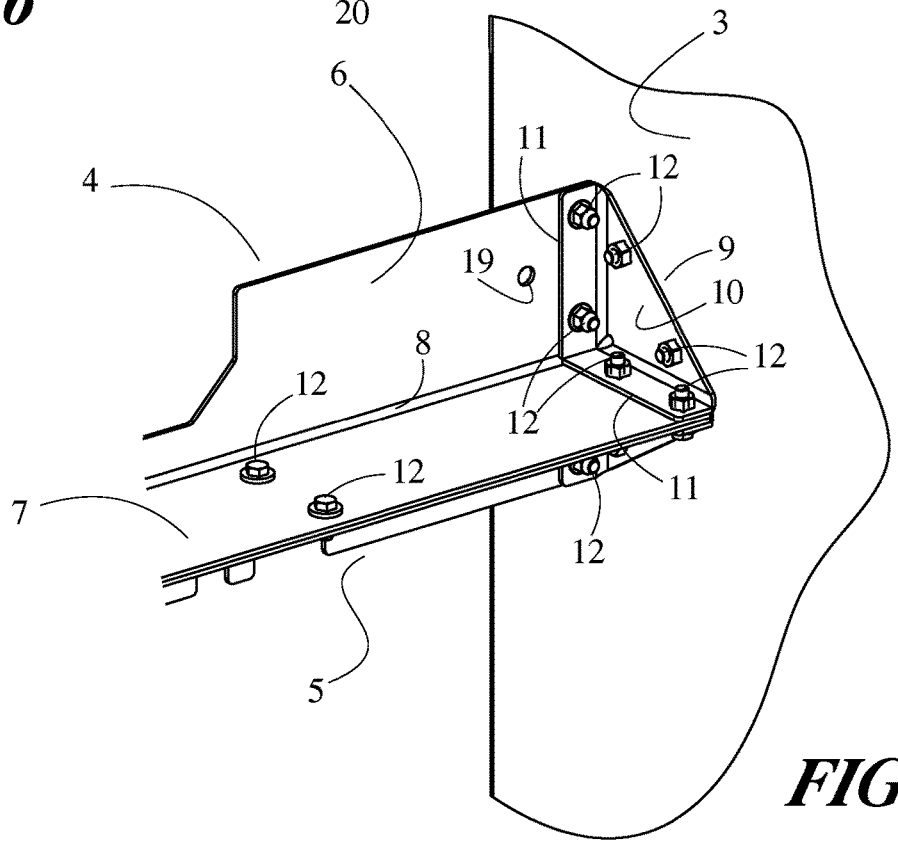
FIG. 7 is a detail perspective view of a portion of the frameless cooling module of FIG. 6.
Figure 8:
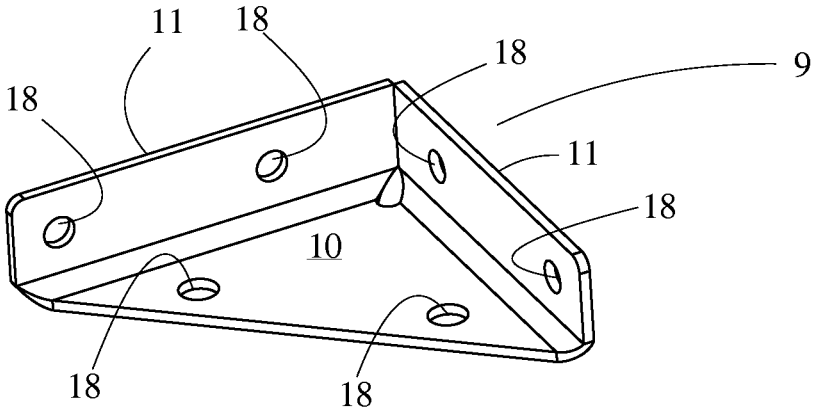
FIG. 8 is a perspective view of a formed corner bracket used within the frameless cooling module of FIG. 4.

The L-shaped stiffener bracket 4 is structurally joined to the shroud panel 3 by a formed corner bracket 9, as depicted in FIG. 7, and is joined to the shroud panel 2 by another formed bracket 9 in a similar fashion. The formed corner bracket 9—shown in isolation in FIG. 8—includes a planar surface 10 which, during assembly of the cooling module 1, is disposed against the shroud panel to thereby join the formed corner bracket 9 to the shroud panel. The planar surface 10 can be in a triangular shape, and particularly in the shape of a right triangle. In alternative embodiments, however, the planar surface 10 can be in some other shape such as, for example, a square or a rectangle. Formed flanges 11 extend perpendicularly from two adjacent edges of the planar surface 10. The formed flanges 11 are perpendicular to one another, and the formed corner bracket 9 is joined to the first planar wall 6 of the L-shaped stiffener bracket 4 by a first one of the formed flanges 11, and to the second planar wall 7 of the L-shaped stiffener bracket by a second one of the formed flanges 11. In this manner, the L-shaped stiffener bracket 4 is joined to the first shroud panel 2 by a first one of the formed corner brackets 9, and is joined to the second shroud panel 3 by a second one of the formed corner brackets 9.

In the exemplary embodiment, the structural connections between the formed corner bracket 9 and both the L-shaped stiffener bracket 4 and the shroud panels are achieved by way of fasteners 12 that extend through aligned apertures in the components to be joined. The fasteners 12 can take the form of threaded bolt and nut fasteners, as shown in the exemplary embodiment, or can take other known forms of mechanical fastening such as, for example, thread-cutting screws, rivets, threaded studs, threaded inserts, self-clinching fasteners, captive fasteners, and the like. In still other embodiments the parts can be joined without the use of fasteners, such as by welding.

Figure 9:
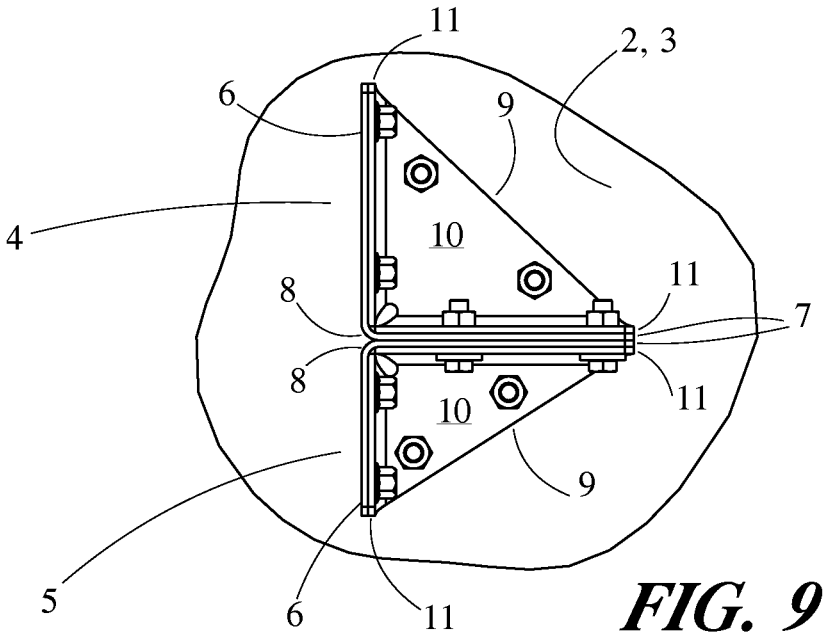
FIG. 9 is a plan view of those portions of the frameless cooling module depicted in FIG. 7.

A second L-shaped stiffener bracket 5 is also provided in the exemplary embodiment, and is joined to the shroud panels 2, 3 by formed corner brackets 9 in a similar fashion to the first L-shaped stiffener bracket 4. As best seen in FIG. 9, the L-shaped stiffener bracket 5 can be arranged so that the second planar walls 7 of the brackets 4 and 5 are disposed against one another with the first planar walls 6 extending in opposite directions, i.e. with the first planar wall 6 of the first L-shaped stiffener bracket 4 extending towards the top 22 of the cooling module 1 and with the first planar wall 6 of the second L-shaped stiffener bracket 5 extending towards the bottom 23 of the cooling module 1. The first planar walls 6 can be, but need not be, aligned in a common plane. It should be observed that the second L-shaped stiffener bracket 5, while advantageous in certain embodiments of the invention, is optional and need not be present in all embodiments of the invention.

As best shown in FIG. 7 and FIG. 9, one or more fasteners 12 can extend through both of the abutting planar walls 7 of the first and second L-shaped stiffener brackets 4, 5 in order to join the brackets together at one or more locations along the width of the cooling module 1. Such a joining of the brackets 4, 5 can further increase the structural rigidity of the brackets and the cooling module 1. In addition, at least some of the fasteners 12 that are used to connect a flange 11 of a formed corner bracket 9 to the planar wall 7 of the first L-shaped stiffener bracket 4 can additionally extend through the planar wall of the second L-shaped stiffener bracket 5 and through a flange 11 of the formed corner bracket 9 used to join that second L-shaped stiffener bracket 5 to a shroud panel, thereby reducing the total number of fasteners that would otherwise be needed to join the L-shaped stiffener brackets to the shroud panels as well as enhancing the structural rigidity of the cooling module 1.

It should be observed that the heights of the first planar walls 6 of the first and second L-shaped stiffener brackets need not be the same. As best seen in FIG. 9, the height of the planar wall 6 of the L-shaped stiffener bracket 5 is less than the height of the planar wall 6 of the L-shaped stiffener bracket 4. Consequently, the dimensions of the formed corner brackets 9 used for each of the two L-shaped stiffener brackets also need not be uniform, as is the case in the exemplary embodiment.

The L-shaped stiffener brackets 4, 5 are used to at least partially support and secure the heat exchangers 30, 31 within the cooling module 1. The heat exchangers 30, 31 are preferably of a style wherein the fluid to be cooled is directed through flow channels between an inlet tank and an outlet tank in a direction generally corresponding to the height direction 25 of the cooling module, with air being directed over the outer surfaces of the flow channels in a direction generally corresponding to the depth direction 24 of the cooling module. Such heat exchangers can be, for example, of a tube and fin or a bar-plate construction, as is known in the art. The tanks of the heat exchangers are preferably equipped with mounting features that align with mounting locations 19 provided on the planar walls 6 of the brackets 4, 5 so that the heat exchangers can be affixed thereto, e.g. by mechanical fasteners.

The cooling module 1 is further provided with a top shroud panel 13 and with a bottom shroud panel 14. As can be seen in FIG. 6, the top shroud panel 13 can be securely attached to the shroud panels 2, 3 by way of additional formed corner brackets 9. Although not visible, the bottom shroud panel 14 can be attached to the shroud panels 2, 3 in a similar fashion. The top shroud panel 13 preferably extends from the back end 21 of the cooling module to the location of the planar wall 6 of the first L-shaped stiffener bracket 4, and preferably terminates at that location with a formed flange 15 that is generally aligned in a common plane with that planar wall 6. Similarly, the bottom shroud panel 14 preferably extends from the back end 21 of the cooling module to the location of the planar wall 6 of the second L-shaped stiffener bracket 5, and preferably terminates at that location with a similar formed flange that is generally aligned in a common plane with that planar wall 6. These formed flanges can additionally be provided with mounting locations for the heat exchangers similar to those provided in the formed flanges 6. The heat exchangers 30 can thereby be secured within the cooling module by way of the first L-shaped stiffener bracket 4 and the top shroud panel 13, while the heat exchangers 31 can thereby be secured within the cooling module by way of the second L-shaped stiffener bracket 5 and the bottom shroud panel 14.

As at least one benefit of the described cooling module construction over that of the prior art cooling module 101, the heat exchangers 30, 31 can be readily removed from the cooling module 1 for service, cleaning, repair, replacement, and the like. After removal of the fasteners used to retain the heat exchangers to the L-shaped stiffener brackets 4, 5 and the top and bottom shroud panels 13, 14, the heat exchangers can be easily removed from the front end 20 of the cooling module 1. In contrast, the heat exchangers as depicted in FIG. 2 are retained within the frame 150, requiring substantial disassembly of the cooling module 101 in order to remove the heat exchangers.

It should be understood that, while the exemplary embodiment shown in the figures and described above includes a second L-shaped stiffener bracket 5, such a second L-shaped stiffener bracket is optional and need not be included. In certain embodiments it may be preferable for the flange 6 of the L-shaped stiffener bracket 4 to be of a suitable length for the mounting of both the heat exchangers 30 and the heat exchangers 31, thereby avoiding the expense of the second bracket 5.

The cooling module 1 can additionally be provided with one or more front brackets 26 that are joined to the shroud panels 2, 3 and extend therebetween at the front 20 of the cooling module 1. In the exemplary embodiment of FIG. 4, two such front brackets 26 are depicted—one at the location (along the height direction 25) of the L-shaped stiffener brackets 4, 5, and the other at the bottom end 23 of the cooling module 1. Although not shown, yet another such a front bracket can be provided at the top end 22 of the cooling module 1. The front brackets can provide additional structural rigidity to the cooling module 1, and can additionally block the undesirable bypassing of air around the cores of the heat exchangers. The front brackets 26 can be readily removed as needed to allow for the removal, repair, or replacement of the heat exchangers.

Various alternatives to the certain features and elements of the present invention are described with reference to specific embodiments of the present invention. With the exception of features, elements, and manners of operation that are mutually exclusive of or are inconsistent with each embodiment described above, it should be noted that the alternative features, elements, and manners of operation described with reference to one particular embodiment are applicable to the other embodiments.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention.

What is claimed is:

1. A frameless cooling module comprising:

first and second shroud panels arranged at opposing sides of the cooling module, each extending from a front of the cooling module to a back of the cooling module in a first direction and from a top of the cooling module to a bottom of the cooling module in a second direction;

an L-shaped stiffener bracket extending between the first and second shroud panels at an intermediate location between the front of the module and the back of the module in the first direction and at an intermediate location between the top of the module and the bottom of the module in the second direction, the L-shaped stiffener bracket having a first planar wall arranged perpendicular to the first direction, a second planar wall arranged perpendicular to the second direction, and a right angle bend joining the first and second planar walls;

first and second formed corner brackets, the first formed corner bracket joining the L-shaped stiffener bracket to the first shroud panel and the second formed corner bracket joining the L-shaped stiffener bracket to the second shroud panel, each of the first and second formed corner brackets having a planar surface by which the respective formed corner bracket is joined to the corresponding one of the first and second shroud panels, a first formed flange extending perpendicularly from the planar surface by which the respective formed corner bracket is joined to the first planar wall of the L-shaped stiffener bracket, and a second formed flange extending perpendicularly from the planar surface by which the respective formed corner bracket is joined to the second planar wall of the L-shaped stiffener bracket; and one or more heat exchangers arranged between the first planar wall and the front of the module in the first direction and between the second planar wall and one of the top and the bottom of the cooling module in the second direction, the one or more heat exchangers being structurally mounted to the first planar wall to at least partially secure the one or more heat exchangers in the cooling module.

2. The frameless cooling module of claim 1, wherein said planar surfaces of the first and second formed corner brackets are each in the shape of a right triangle.

3. The frameless cooling module of claim 1, wherein at least one of the first and second formed corner brackets is joined to the L-shaped stiffener bracket by fasteners extending through aligned apertures of the L-shaped stiffening bracket and the formed flanges of said formed corner bracket.

4. The frameless cooling module of claim 1, wherein at least one of the first and second formed corner brackets is joined to the corresponding one of the first and second shroud panels by fasteners extending through aligned apertures of the planar surface of said one of the first and second formed corner brackets and said shroud panel.

5. The frameless cooling module of claim 1, further comprising:

a top panel arranged at the top of the cooling module extending between and joined to the first and second shroud panels; and a bottom panel arranged at the bottom of the cooling module extending between and joined to the first and second shroud panels, wherein at least one of the top and the bottom panels extends from the back of the cooling module to an intermediate location between the front of the module and the back of the module in the first direction.

6. The frameless cooling module of claim 5, wherein said at least one of the top and the bottom panels includes a flange aligned in a common plane with the first planar wall of the L-shaped stiffener bracket, the one or more heat exchangers being structurally mounted to the flange of said at least one of the top and the bottom panels to at least partially secure the one or more heat exchangers in the cooling module.

7. The frameless cooling module of claim 1, wherein the L-shaped stiffener bracket is a first L-shaped stiffener bracket, further comprising:

a second L-shaped stiffener bracket extending between the first and second shroud panels at an intermediate location between the front of the module and the back of the module in the first direction and at an intermediate location between the top of the module and the bottom of the module in the second direction, the second L-shaped stiffener bracket having a first planar wall arranged perpendicular to the first direction, a second planar wall arranged perpendicular to the second direction, and a right angle bend joining the first and second planar walls of the second L-shaped stiffener bracket;

third and fourth formed corner brackets, the third formed corner bracket joining the second L-shaped stiffener bracket to the first shroud panel and the fourth formed corner bracket joining the second L-shaped stiffener bracket to the second shroud panel, each of the third and fourth formed corner brackets having a planar surface by which the respective formed corner bracket is joined to the corresponding one of the first and second shroud panels, a first formed flange extending perpendicularly from the planar surface by which the respective formed corner bracket is joined to the first planar wall of the second L-shaped stiffener bracket, and a second formed flange extending perpendicularly from the planar surface by which the respective formed corner bracket is joined to the second planar wall of the second L-shaped stiffener bracket; and one or more heat exchangers arranged between the first planar wall of the second L-shaped stiffener bracket and the front of the module in the first direction and between the second planar wall of the second L-shaped stiffener bracket and the other one of the top and the bottom of the cooling module in the second direction, said one or more heat exchangers being structurally mounted to the first planar wall of the second L-shaped stiffener bracket to at least partially secure said one or more heat exchangers in the cooling module.

8. The frameless cooling module of claim 7, wherein the first planar wall of the first L-shaped stiffener bracket is aligned in a common plane with the first planar wall of the second L-shaped stiffener bracket.

9. The frameless cooling module of claim 7, wherein the first planar wall of one of the first and second L-shaped stiffener brackets extends from the second planar wall of the respective L-shaped stiffener bracket towards the top of the cooling module, and wherein the first planar wall of the other of the first and second L-shaped stiffener brackets extends from the second planar wall of the respective L-shaped stiffener bracket towards the bottom of the cooling module.

10. The frameless cooling module of claim 7, wherein the second planar wall of the first L-shaped stiffener bracket abuts against and is joined to the second planar wall of the second L-shaped stiffener bracket.

11. The frameless cooling module of claim 10, wherein the first and second L-shaped stiffener brackets are joined together at least in part by one or more fasteners that extend through aligned apertures in the second planar wall of the first L-shaped stiffener bracket, the second planar wall of the second L-shaped stiffener bracket, the second formed flange of at least one of the first and second formed corner brackets, and the second formed flange of at least one of the third and fourth formed corner brackets.

12. The frameless cooling module of claim 7, wherein the first planar wall of the first L-shaped stiffener bracket is offset from the first planar wall of the second L-shaped stiffener bracket in the first direction.

* * * * *